US012660903B2

(12) United States Patent
Kazanceva

(10) Patent No.: US 12,660,903 B2
(45) Date of Patent: Jun. 23, 2026

(54) HOLDER FOR HAIRDRYER

(71) Applicant: Elena Igorevna Kazanceva, g. Ekaterinburg (RU)

(72) Inventor: Elena Igorevna Kazanceva, g. Ekaterinburg (RU)

( * ) Notice: Subject to any disclaimer, the term of this patent is extended or adjusted under 35 U.S.C. 154(b) by 748 days.

(21) Appl. No.: 18/016,081

(22) PCT Filed: Jul. 15, 2020

(86) PCT No.: PCT/RU2020/000356
§ 371 (c)(1),
(2) Date: Jan. 13, 2023

(87) PCT Pub. No.: WO2022/015191
PCT Pub. Date: Jan. 20, 2022

(65) Prior Publication Data
US 2023/0270225 A1 Aug. 31, 2023

(51) Int. Cl.
*A45D 20/12* (2006.01)
*A45D 20/10* (2006.01)
(Continued)

(52) U.S. Cl.
CPC ..... *A45D 20/12* (2013.01); *A45D 2020/126* (2013.01)

(58) Field of Classification Search
CPC ..... A45D 20/10; A45D 20/12; A45D 20/124; A45D 20/126; F26B 18/00; A47F 5/00
(Continued)

(56) References Cited

U.S. PATENT DOCUMENTS 4,696,447 A 9/1987 Strecker
6,390,424 B1 5/2002 Kidushim et al.
(Continued)

FOREIGN PATENT DOCUMENTS

JP 2017124135 A 7/2017

OTHER PUBLICATIONS

Office Action dated Sep. 6, 2024 issued in corresponding Brazilian Application No. 112022024586-6.
(Continued)

*Primary Examiner* — Deming Wan
(74) *Attorney, Agent, or Firm* — KATTEN MUCHIN ROSENMAN LLP

(57) ABSTRACT

The invention relates to the field of devices for holding hairdryers. The technical result is mobility and more reliable fastening of a hairdryer. A holder for hairdryer includes an elongated body, which has an U-shaped cross-section and is made of an resilient material; the flat lateral sides of the fastening end of the holder body are provided with opposite holes for receiving an axis of the holder body, the axis being detachably fastened from the outside of both lateral sides of the body. One end of the holder body axis is threaded for connection with a fixing screw designed to press or release the lateral sides of the holder body relative to one another. The holder body is disposed on the holder body axis for rotation thereabout. Provided on the lateral sides of the opposite end of the holder body are opposing holes for receiving the ends of an resilient belt so that an opening is formed between the inside surface of the holder body and the belt for receiving a handle of a hairdryer. Fastened between the lateral sides of the holder body on the axis thereof is a stand that is rotatable around holder body axis.

10 Claims, 7 Drawing Sheets

(51) Int. Cl.
*A47F 5/00* (2006.01)
*F26B 19/00* (2006.01)

(58) Field of Classification Search
USPC ..... 248/206, 309, 314; 34/90, 97
See application file for complete search history.

(56) References Cited

U.S. PATENT DOCUMENTS

| | | | | |
|---|---|---|---|---|
| 7,077,370 | B2 * | 7/2006 | Lin | A45D 20/12 248/185.1 |
| 8,151,481 | B2 | 4/2012 | Perez, Jr. | |
| 2004/0075033 | A1 | 4/2004 | Fujitaka | |
| 2015/0157107 | A1 * | 6/2015 | Gosnay | A45D 20/12 34/96 |
| 2019/0142132 | A1 * | 5/2019 | Nelson | H01M 50/247 34/96 |

OTHER PUBLICATIONS

International Search Report and Written Opinion Dated Mar. 25, 2021 for corresponding application PCT/RU2020/000356.
Search Report dated Apr. 25, 2024, issued in corresponding application AE P6000064/2023.
Examination Report dated Apr. 25, 2024, issued in corresponding application AE P6000064/2023.

* cited by examiner

HOLDER FOR HAIRDRYER

BACKGROUND OF THE INVENTION

The invention relates to the field of devices designed to hold a hairdryer to enable the user to use both hands when combing and styling hair.

The U.S. Pat. No. 8,151,481 discloses a universal hair dryer holder comprising a hair dryer, a base with a suction means for detachable attachment the base to a flat surface, a lever for selectively actuating the suction means; another flexible adjustable lever-stand selectively bendable along its length extending from the base; a wire frame holder confining an opening into which a hair dryer handle is inserted for holding it at the end of the lever-stand opposite the base; the opposite sides of the wire frame are provided with two loops opposite each other, designed to accommodate an elastic cord placed in the loops with the possibility of sliding within them and designed to partially cover the outside of the hair dryer, the elastic cord containing at its ends stopper elements larger than the loop to prevent movement of the hair dryer, the elastic cord being selectively detachable from the holder (e.g. by removing the locking elements connected to the elastic cord following the known principle of attaching locking elements to hood laces of jackets); the suction means contains a diaphragm which moves between a flat side parallel to the supporting surface and a side partially raised above the supporting surface to create a vacuum between them and to fix the base rigidly to the surface.

The disadvantage of the hair dryer holder according to U.S. Pat. No. 8,151,481 is its limited capabilities since it can only be attached to flat surfaces. Also, the disadvantage of the known holder is the unreliability of the hair dryer mounting; the position of the hair dryer is not fixed rigidly, which will lead to a deviation of the hair dryer from the position chosen by the user during its operation.

The U.S. Pat. No. 7,077,370 discloses a hand-held hair dryer support comprising a base having two sides, an upper outer side and a lower outer side; attachment ears formed on the upper outer side of the base in common with it, located on opposite edges of the upper outer side of the base opposite each other and having corresponding inner surfaces, outer surfaces, recessed areas made respectively on the outer surfaces, recessed areas of the attachment ears on their inner outer sides act as bottoms, in which holes are made with a common axis of symmetry; two attachment assemblies comprising two washers; two lock washers; and two covers; and the washers and lock washers mounted in series in the recessed areas, the lock washers resting on the bottoms of the recessed areas; a retainer mounted pivotally on the upper surface of the base on an axis inserted in the holes of the retainer ears and having two parallel curved sides with an intermediate space between them; a proximal end; a distal end; a proximal end is mounted between the retainer ears and mounted on an axis passing through the holes in the ears of the retainer and in the holes made in the side faces of the retainer.

The holder according to U.S. Pat. No. 7,077,370 is selected as the closest analogue (prototype).

The disadvantage of the holder according to U.S. Pat. No. 7,077,370 is its limited functionality due to the limited possibilities of adjusting the position of the hairdryer, which is only by tilting the holder forwards and backwards. In addition, the known holder can only be attached to flat surfaces employing a permanent connection. The holder's location cannot be changed or can be changed by performing a rather complicated manipulation, including disconnecting the screw connection or removing the adhesive tape. In addition, the use of such fastening means causes damage to the surface to which the holder is supposed to be attached.

SUMMARY OF THE INVENTION

The technical problem solved by the proposed invention is the creation of a holder for a hairdryer, mobile and compact for moving in space and installation in a place convenient for the consumer, with a wide range of functions for attaching to various surfaces, easy to use, simple and reliable.

The technical result to be achieved by the invention is an increase a range of functionality, mobility, improved ease of operation, increased reliability of fixing the hairdryer.

The technical result is achieved due to the fact that in holder for a hairdryer, comprising an elongated body having a U-shaped cross-section and being made of an elastic material, flat lateral sides of a fastening end of the holder body are provided with opposite holes for accommodating an axis of the holder body, detachably fastened to the outside of both sides of the holder body, wherein one end of the holder body axis is provided with a thread for connection with a fixing screw configured to press or release the lateral sides of the holder body in relation to each other, the holder body is arranged on the axis of the holder body with the possibility of rotation around it, on lateral sides of the opposite end of the holder body are provided opposite holes for accommodating therein ends of an elastic belt with forming an opening between the inner surface of the holder body and the belt to accommodate a handle of the hairdryer, according to the invention between the sides of the holder body on its axis is fastened a stand, made rotatable around the axis of the holder body, for this purpose one end of the stand is provided with not less than two parallel flat protrusions with holes, by means of which the stand is arranged on the holder body axis, wherein the transverse dimension of the stand being less than the distance between the lateral sides of the holder body, inside the holder body on its fastening end between the sides, an insert made of an elastic material is tightly mounted and fastened, wherein the insert is provided either as a separate element or integral with the holder body, the insert is provided with a longitudinal section of a W-shaped form, the vertical sides of the longitudinal section of the W-shaped insert are provided with through holes to accommodate therein the axis of the holder body, wherein the flat protrusions of the stand are arranged in the grooves of the W-shaped insert, the stand is made cylindrical, consisting of two parts, wherein the part of the stand connected to the holder body by means of flat protrusions is made with T-shaped longitudinal section, and the other part of the stand is made with an H-shaped longitudinal section, the vertical portion of the T-shaped part of the stand is configured to be arranged in the upper groove of the H-shaped part of the stand, the dimensions of the vertical portion of the T-shaped part of the stand correspond to the dimensions of the upper groove of the H-shaped part of the stand to allow unrestricted rotation of the vertical portion of the T-shaped part of the stand inside the groove of the H-shaped part of the stand, simultaneously providing for a contact between the upper end face surface of the H-shaped part and the horizontal surface of the T-shaped part of the stand arranged around its vertical portion, in the vertical portion of the T-shaped part of the stand is provided a central longitudinal threaded hole, in the horizontal portion of the H-shaped part of the stand is provided a central through hole, the diameter of which corresponds to the diameter of the longitudinal threaded hole provided in the T-shaped part of the stand, both parts of the stand are interconnected by means of a screw installed at the side of the lower groove of the H-shaped part of the stand, the screw passing freely the central hole in the horizontal portion of the H-shaped part of the stand is screwed into the central longitudinal threaded hole in the vertical portion of the T-shaped part of the stand, the length of the screw leg is larger than the combined height of both holes so that a free part of the screw leg, the length of which is measured from its head to the horizontal portion of the H-shaped part of the stand, can be arranged in the lower groove of the H-shaped part of the stand, the contacting with each other surfaces of the H-shaped part and T-shaped part of the stand are provided in a zigzag shape with the possibility of arranging a zigzag protrusion of one contacting surface in the zigzag groove of the other contacting surface, on the free part of the screw leg between the screw head and the horizontal portion of the H-shaped part of the stand is arranged a first spring in a normally compressed state; in the lower groove of the H-shaped part of the stand are arranged two T-shaped elements, the vertical portions of which are connected with each other by means of an axis with the possibility of rotation of the T-shaped elements around it, wherein the horizontal portions of both T-shaped elements are oriented in opposite directions, the horizontal portion of the first T-shaped element is facing the horizontal portion of the H-shaped part of the stand, wherein in the horizontal portion of the first T-shaped element a cavity is provided, in which is arranged a second spring in a normally released state with its longitudinal axis directed along the horizontal portion of the first T-shaped element, on the lateral surface of the horizontal portion of the first T-shaped element is provided a hole communicating with the first hole provided in the lower vertical portion of the H-shaped part of the stand, said holes are intended for accommodating an outwardly extending button having an elongated shape and acting as a stopper for the upper T-shaped element when it engages with said holes, the button is mounted with the possibility of impacting the second spring, whereby the longitudinal movement of the button causes a corresponding compression of the second spring with subsequent movement of the button inside the cavity, wherein the second spring is arranged with the button disengaged from the first hole provided in the lower vertical portion of the H-shaped part of the stand, in the lower groove of the H-shaped part of the stand between the horizontal portion of the H-shaped part of the stand and the horizontal portion of the first T-shaped element coaxially with the stand is arranged a normally compressed third spring to ensure pushing out of the first T-shaped element outwardly when the button is released from engagement with the first hole provided in the lower vertical portion of the H-shaped part of the stand, wherein at the fully extended position of the first T-shaped element the location of the axis connecting both T-shaped elements on the outside is provided for, fixation of the extended position of the first T-shaped element is provided for by engaging the button with a second hole provided in the lower vertical portion of the H-shaped part of the stand and arranged below the first hole provided in the lower vertical portion of the H-shaped part of the stand, and engagement of the button with the second hole is provided for when the horizontal portion of the first T-shaped element reaches the level of the second hole and when the axes of the button and the second hole coincide, under the action of the compressed second spring outward movement of the button is provided into the second hole for engagement with it.

The outer surface of the horizontal portion of the second T-shaped element can be provided with a central threaded hole for connection with means for fastening the stand to support surfaces.

In order to secure the stand to a flat horizontal surface, the stand can be connected to a vacuum cup provided with a threaded support pin configured to be screwed into the central threaded hole, provided on the outer surface of the horizontal portion of the second T-shaped element.

The second T-shaped element can be connected to a claw clamp provided with a threaded support pin configured to be screwed into the central threaded hole, provided on the outer surface of the horizontal portion of the second T-shaped element.

The fastening of the stand to the vertical surface is provided for by two vacuum cups provided with support pins configured to be screwed into the threaded holes, provided one above the other in the vertical portion of the H-shaped part of the stand.

The horizontal portion of the second T-shaped element in the initial position can be arranged outside the lower groove of the H-shaped part of the stand.

The body of the holder can be made of an elastic plastic.

The body of the holder can be made of aluminum.

The insert can be made of an elastic plastic.

The insert can be made of aluminum.

The claimed holder for a hairdryer, like the above-mentioned prototype, comprises an upper part, which is an elongated holder body having a U-shaped cross-section. Flat lateral sides of a fastening end of the holder body are provided with opposite holes, through which the axis of the holder body passes, fixed at both ends with the possibility of its detaching. The ends of the holder body axis extend outward on both lateral sides of the holder body and are provided with a thread, whereby one end of the holder body axis is connected to a fixing screw and the other end of the holder body axis is fixed by a screw or nut or other similar means. The fixing screw is configured to press the lateral sides of the holder body toward each other or vice versa to release them. By positioning the holder body on the axis of the holder body, it is possible to rotate the holder around the axis and to change the position of the hairdryer by tilting the holder body.

On the lateral sides of the opposite free end of the holder body are provided opposite holes. These holes are made for accommodating therein ends of an elastic, resilient cord (or band, belt, cord with Velcro), forming an opening between the inner surface of the holder body and the belt, into which a handle of a hairdryer is accommodated. The outer edges of the holder body may have a convex shape for ease of placement of elastic cords or band or belt or cord with Velcro.

Due to the use of an elastic cord or band or belt or cord with Velcro and due to the possibility to press or release of the lateral sides by the fixing screw, it is possible to adapt the internal size of the holder body to handle of different sizes.

Between the sides of the holder body, a stand is fastened to the axis of the holder body and configured to rotate around the axis of the holder body. For this purpose one end of the stand is provided with at least two parallel flat protrusions with holes, by means of which the stand is arranged on the axis of the holder body. The presence of at least two such parallel flat protrusions is caused by the necessity of more reliable fixing of the position of the stand on the axis of the holder body and reduction of the possibility of uncontrolled lateral tilting of the holder body relative to the stand.

When storing the holder when not in use, the stand rotates around the axis of the holder body and takes a position inside it, being held inside the holder body by an elastic cord or by the fixing screw of the central axis. In this case, the overall dimensions of the holder are reduced by almost two times.

The possibility of fixing not only the holder body on the body axis, but at the same time the possibility of fixing the position of the holder body relative to the stand, while maintaining the function of folding the stand into the inside of the body, is provided by the following.

Inside the body at its fastening end, the insert is tightly mounted and fastened relative to the body, which like the holder body is made of an elastic material. The insert can be made integral with the holder body. The elastic material can be either elastic plastic or aluminum or another elastic material.

The longitudinal cross-section of the insert is made with a W-shaped form, wherein all side surfaces of the W-shaped insert are made with holes located opposite the holes made in the lateral sides of the fastening end of the holder body. These holes are configured to accommodate therein the axis of the holder body. The grooves of the W-shaped insert are intended to accommodate therein the flat protrusions of the stand. In this case, the stand has the possibility to perform rotational movements inside the grooves of the W-shaped insert around the axis of the holder body. The fixing screw ensures that the sides and vertical elements of the insert are pressed against the sides of the flat longitudinal protrusions of the stand, thus fixing the position of the body relative to the stand.

The possibility of changing the position of the holder not only by changing the angle between the longitudinal axes of the holder body and the stand, but also due to the possibility of rotation of the holder body around the longitudinal axis of the stand, as well as due to the possibility of increasing the length of the stand, is provided in the following way.

The stand is made cylindrical, consisting of two parts. The part of the stand connected to the holder body is made with a T-shaped longitudinal section, and the other part of the cylindrical stand is made with an H-shaped longitudinal section.

Flat protrusions described above are made on the outer surface of the horizontal portion of the T-shaped part of the stand.

The vertical portion of the T-shaped part of the stand is designed to be arranged in the upper groove of the H-shaped part of the stand. The dimensions of the vertical portion of the T-shaped part of the stand correspond to the dimensions of the upper groove of the H-shaped part of the stand to allow unrestricted rotation of the vertical portion of the T-shaped part of the stand inside the groove of the H-shaped part of the stand, providing for a contact between the upper end face surface of the H-shaped part of the stand and the horizontal surface of the T-shaped part of the stand arranged around its vertical part.

Both parts of the stand are connected together as follows. In the vertical portion of the T-shaped part of the stand is provided a central longitudinal threaded hole. In the horizontal portion of the H-shaped part of the stand is provided a through central hole, the diameter of which corresponds to the diameter of the longitudinal threaded hole provided in the other part of the stand.

Both parts of the stand are interconnected by a screw installed on the side of the lower groove of the H-shaped part of the stand. The screw passes freely through the central hole in the horizontal portion of the H-shaped part of the stand and is screwed in its initial position until it stops in the central longitudinal threaded hole in the vertical portion of the T-shaped part of the stand.

The length of the screw leg is larger than the combined height of the two holes so that in the lower groove of the H-shaped part of the stand will be accommodated a part of the screw leg, the length of which is measured from its head to the horizontal portion of the H-shaped part of the stand.

The contacting with each other surfaces of the H-shaped and T-shaped parts of the stand are provided in a zigzag shape with the possibility of arranging a zigzag protrusion of one contacting surface in the zigzag groove of the other contacting surface. In this way, the position of the T-shaped part of the stand relative to the H-shaped part is fixed and their spontaneous free rotation relative to each other is prevented.

On the free part of the screw leg between the screw head and the horizontal portion of the H-shaped part of the stand is arranged a first spring in a normally compressed state. When the T-shaped part of the stand rotates around its axis, the vertical portion makes a rotational movement along the threads, increasing the length of the free part of the screw leg located in the lower groove of the H-shaped part of the stand. At the same time, when the T-shaped part of the stand rotates relative to the H-shaped part, their zigzag surfaces, which are in contact with each other, move relative to each other. This movement of one zigzag surface in relation to the other is provided by the first spring, which makes it possible to lift the T-shaped part of the stand in relation to the H-shaped part due to the free positioning the screw leg in the central hole of the H-shaped part of the stand. After the necessary rotation of the T-shaped part of the stand relative to the H-shaped part is performed, the rotation of the T-shaped part is stopped, wherein due to the compressive force of the first spring, the T-shaped part of the stand is pressed against the H-shaped part of the stand in a position where the protrusions of one zigzag surface are located in the grooves of the other zigzag surface.

The possibility of extending the stand is realized as follows.

In the lower groove of the H-shaped part of the stand are arranged two T-shaped elements, the vertical portion of which are connected with each other by means of an axis with the possibility of the T-shaped elements rotating around it. Due to such interconnection the horizontal portions of both T-shaped elements will be oriented in opposite directions.

The horizontal portion of the first T-shaped element faces the horizontal of the H-shaped part of the stand. Wherein in the horizontal portion of the first T-shaped element a cavity is provided, in which is arranged a normally released second spring, the longitudinal axis of which is directed along the horizontal portion of the first T-shaped element. On the side surface of the horizontal portion of the first T-shaped element is provided a hole, communicating with the first hole provided in the lower vertical portion of the H-shaped element. Said holes are intended for accommodating an outwardly extending button having an elongated shape and acting as a stopper for the upper T-shaped element in its initial position, preventing its vertical movement when the button stem is placed in the first hole, made in the lower vertical portion of the H-shaped part of the stand. The button is mounted with the possibility of influencing the second spring, whereby the longitudinal movement of the button causes the corresponding compression of the second spring with the subsequent movement of the button into the cavity, wherein the second spring is arranged with the button released from the engagement with the first hole provided in the lower vertical portion of H-shaped part of the stand.

A normally compressed third spring is arranged in the lower groove of the H-shaped part of the stand between the horizontal portion of the H-shaped part of the stand and the horizontal portion of the first T-shaped element. When the button is moved into the cavity, in which the second spring is arranged, and the button is released from engagement with the lower vertical portion of the H-shaped part of the stand, the first T-shaped element under the influence of the third spring is pushed outwardly from the lower groove of the H-shaped part of the stand, while pushing out the second T-shaped element outwardly. In the fully extended outward position of the T-shaped elements, the axis connecting them is positioned outside, providing possibility to change the angle between the longitudinal axes of the vertical portions of the two T-shaped elements.

The fixation of the position of the first T-shaped element in the extended relative to the initial position is carried out when the horizontal portion of the first T-shaped element reaches the level, at which a second hole is provided in the lower vertical portion of the H-shaped part of the stand to accommodate the button. When the axes of the button and the second hole coincide, the button under the action of the compressed second spring, tending to expand, extends into the second hole for engagement with it and thereby securing the extended position of the first T-shaped element.

A threaded central hole is made on the outer surface of the horizontal portion of the second T-shaped element is provided for connection with means for fastening the stand to support surfaces.

In order to provide fastening the stand to a flat horizontal surface, the stand can be connected to a vacuum cup provided with a threaded support pin configured to be screwed into the central threaded hole made on the outer surface of the horizontal portion of the second T-shaped element.

The second T-shaped element can be connected to a claw clamp provided with a threaded support pin configured to be screwed into the central threaded hole made on the outer surface of the horizontal portion of the second T-shaped element, to enable the stand to be mounted on the headboard, a pipe, etc.

The stand can be fastened to a vertical surface by means of two vacuum cups provided with support pins configured to be screwed into threaded holes made one above the other in the vertical portion of the H-shaped part of the stand.

The T-shape form of both elements is due to the need to reduce the friction forces when they move in the lower groove of the H-shaped part of the stand. The horizontal portion of the second T-shaped element can be in its initial position located outside the lower groove of the H-shaped part of the stand to allow the means for fastening to be easily screwed into it.

The connection of the vertical portions of both T-shaped elements by means of an axis with the possibility of their rotation around said axis allows to vary the angle of the stand relative to the supporting surface by rotating of the second T-shaped element in its extended position, the fixation of the angle of inclination of both T-shaped elements is carried out by means of a screw or other fixation method—for example, a tongue-and-groove.

It is advisable to perform the central hole made on the outer surface of the second T-shaped element unified in order to enable the holder to be connected to a stand for cameras, etc.

DETAILED DESCRIPTION

Figure 1:
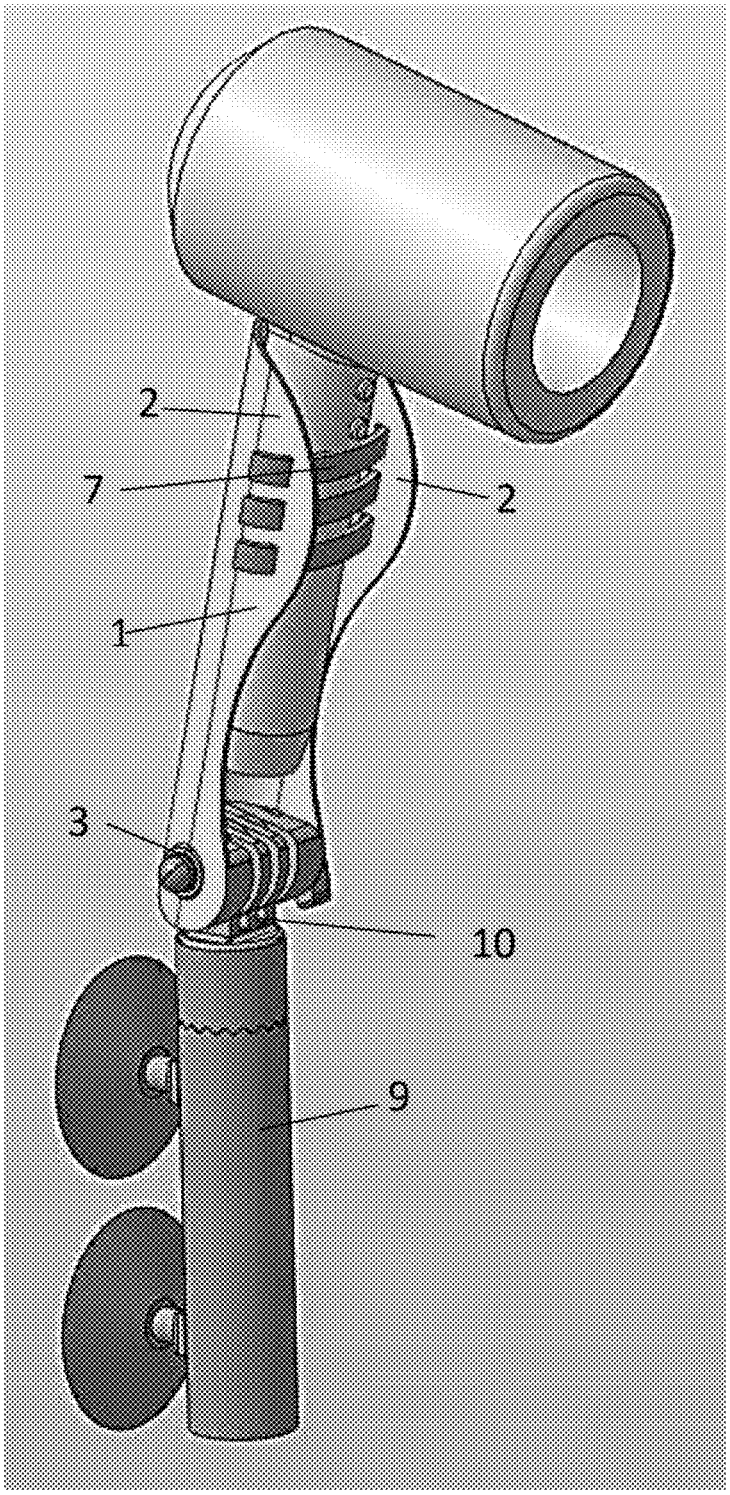
FIG. 1 shows a general view of the claimed holder for hairdryer with fastening to a vertical surface.
Figure 2:
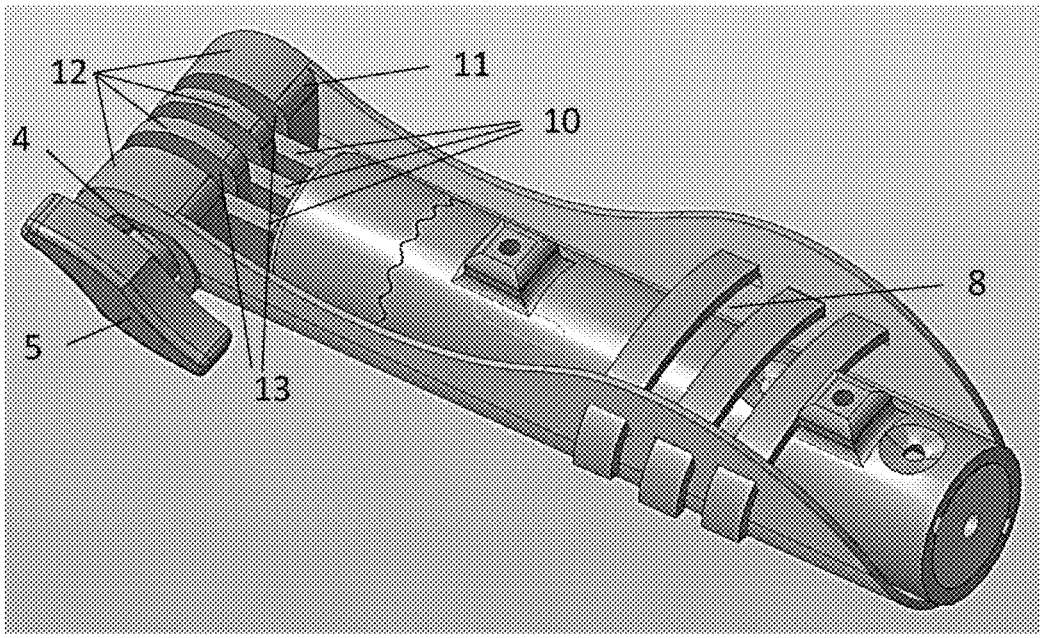
FIG. 2 shows the claimed holder for hairdryer in the folded form.
Figure 3:
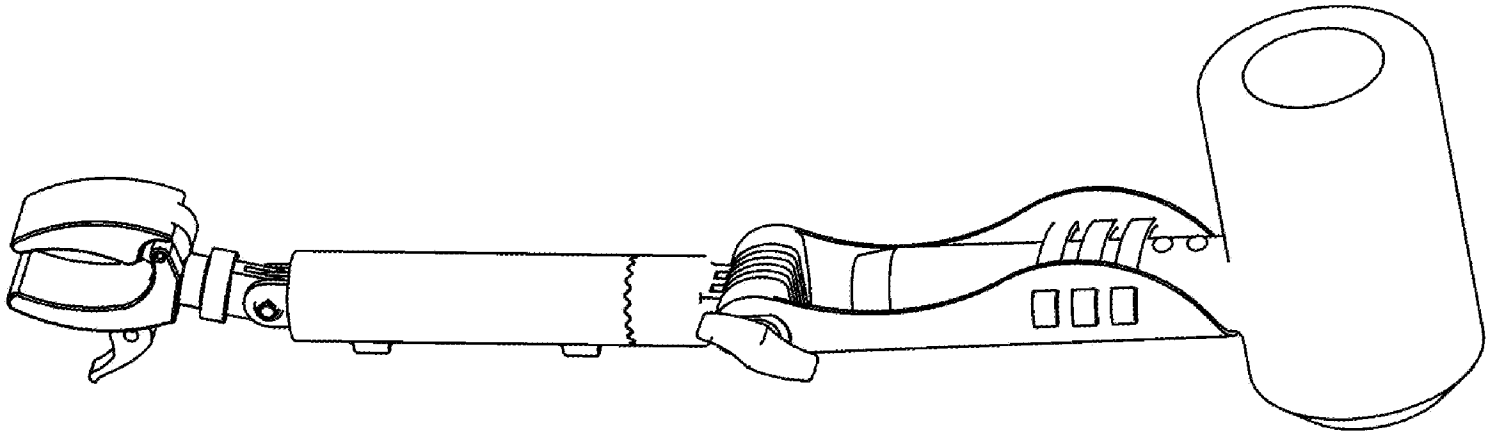
FIG. 3 shows a general view of the claimed holder for hairdryer with means for fastening in the form of a claw clamp claw.
Figure 4:
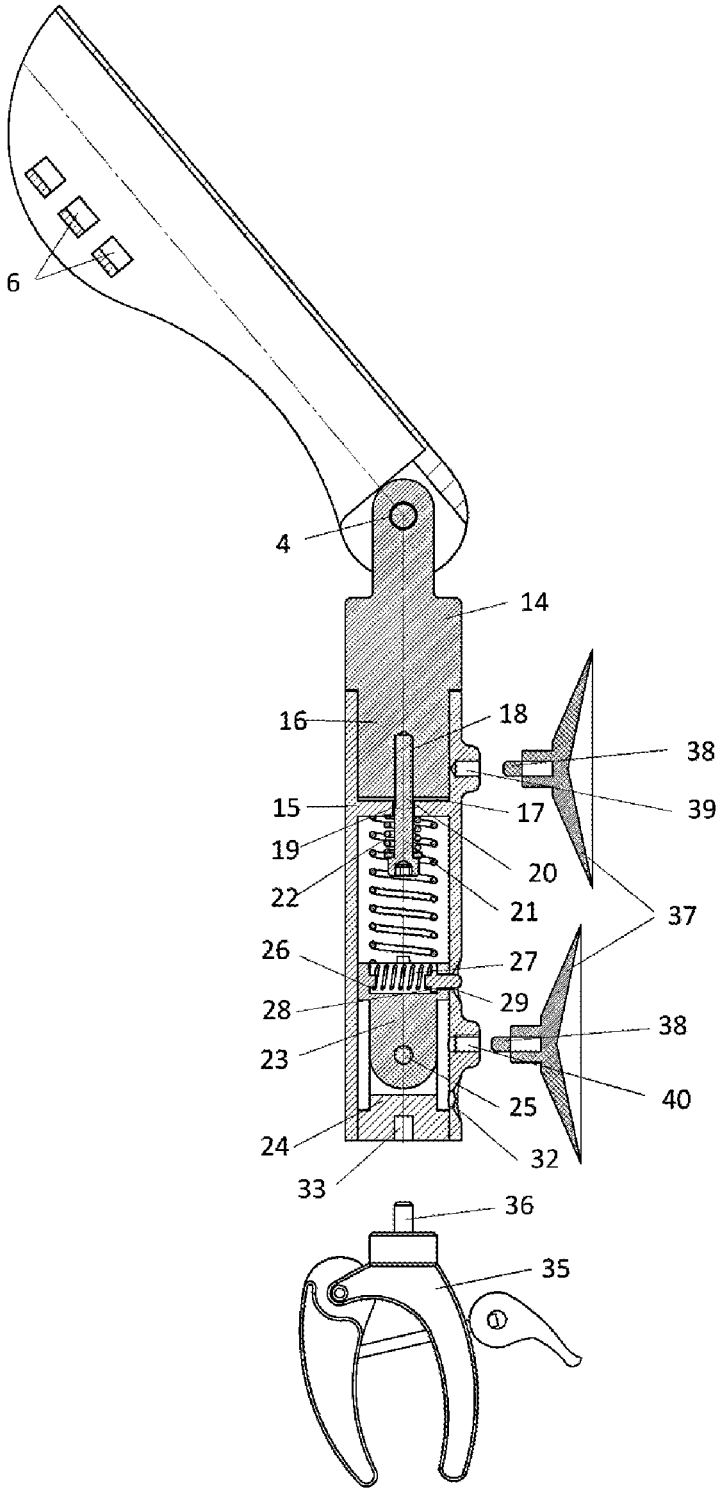
FIG. 4 shows a sectional view of the claimed holder for hairdryer in its original state.
Figure 5:
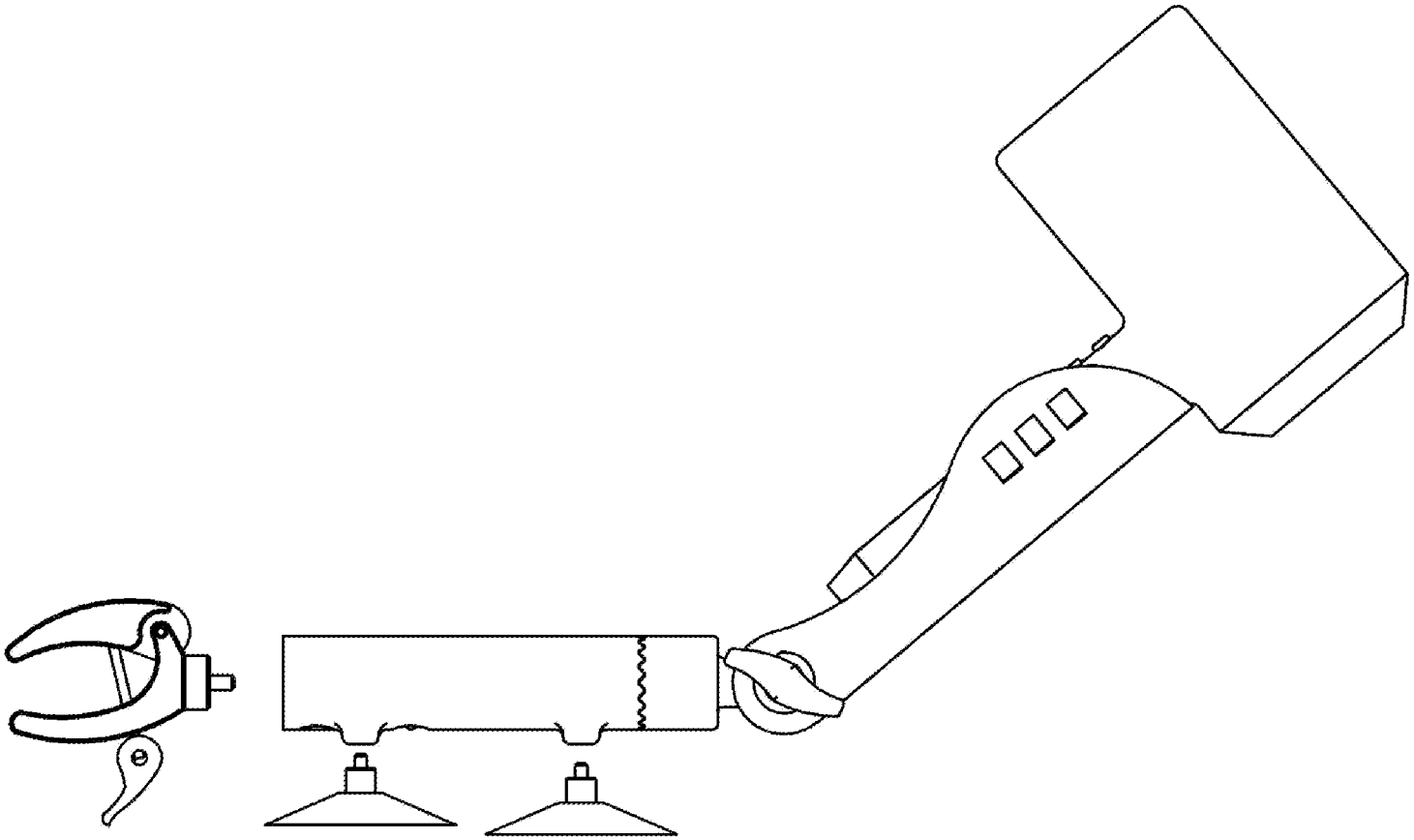
FIG. 5 shows a side view of the claimed holder for hairdryer in a bent position.
Figure 6:
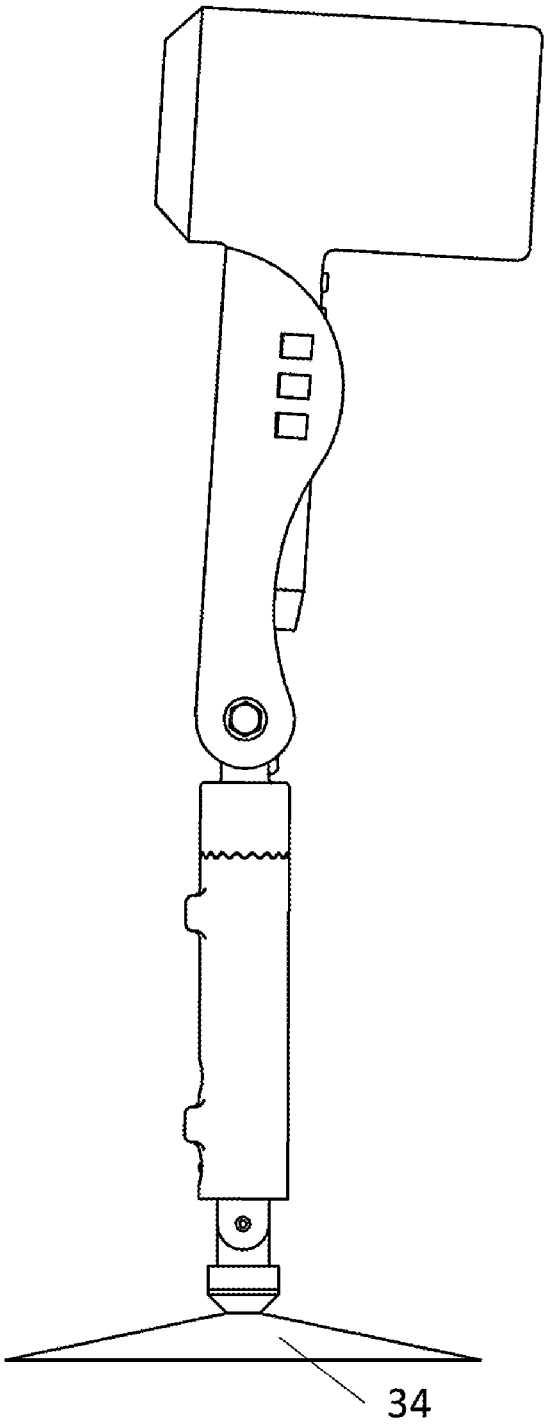
FIG. 6 shows a general view of the claimed holder for hairdryer with fastening to a horizontal flat surface.
Figure 7:
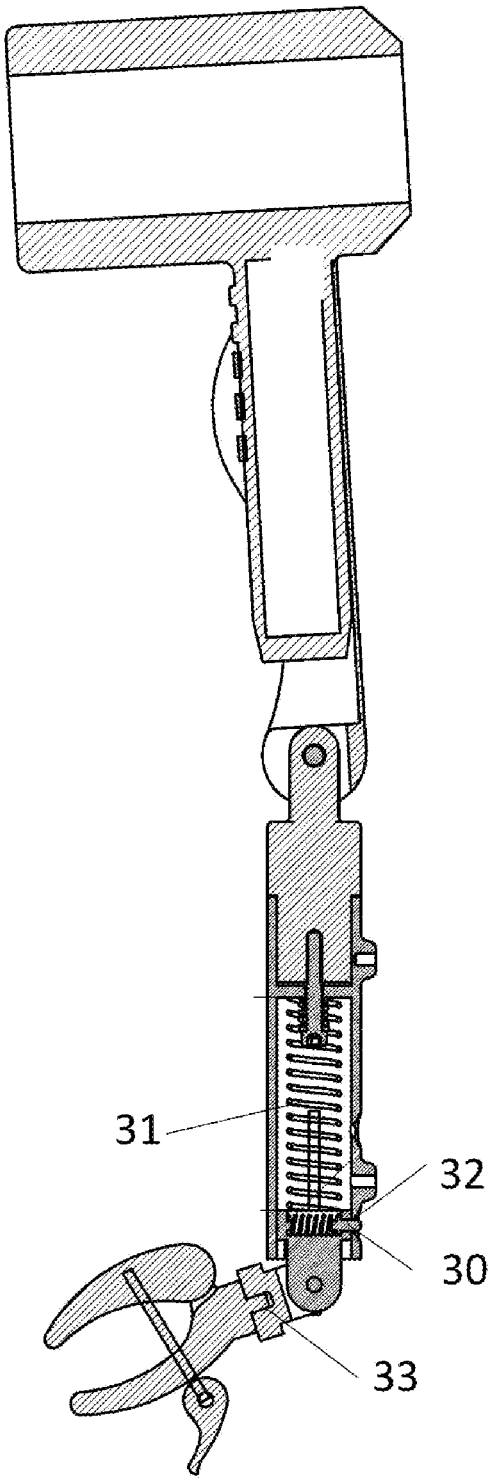
FIG. 7 shows a sectional view of the claimed holder for hairdryer in position extended in length.

The holder for a hairdryer comprises an elongated body 1, having a U-shaped cross-section and being made of an elastic plastic. The holder body can also be made of any elastic material (e.g. plastic, metal, aluminum, carbon fiber, composite material, wood). Opposite holes 3 are made on the flat lateral sides 2 of the fastening end of the holder body 1 for accommodating an axis 4 of the holder body, detachably fastened to the outside of both sides of the holder body 1. One end of the axis 4 of the holder body 1 is provided with a thread for connection with the fixing screw 5, configured to press or release the lateral sides 2 of the holder body in relation to each other. The holder body 1 is arranged on the axis 4 with the possibility of rotation around it. On the lateral sides 2 of the opposite end of the holder body are provided opposite holes 6 for accommodating in them the ends of the elastic belt 7 (belt 7 can be made in the form of any elastic cord, ribbon, strip) with the formation of an opening 8 between the inner surface of the holder body 1 and belt 6 for accommodating the handle of the hairdryer. Between the lateral sides 2 of the holder body on the axis 4 is fastened the stand 9, made with the possibility of rotation around the axis 4. For this purpose one end of the stand 9 is provided not less than two parallel flat protrusions 10 with holes, by means of which the stand 9 is arranged on the axis 4. The transverse dimension of the stand 9 is smaller than the distance between the sides 2 of the holder body. Inside the body 1 in its fastening end between the sides 2, an insert 11 made of an elastic plastic is tightly mounted and fastened. The insert 11 is made integral with the holder body 1. The insert 11 is made with a longitudinal section of a W-shaped form, the vertical sides 12 of the longitudinal section of the W-shaped insert are provided with through holes to accommodate the axis 4, wherein the flat protrusions 10 of the stand are arranged in the grooves 13 of the W-shaped insert 11. The stand is cylindrical, consisting of two parts, wherein the part 14 of the stand 9, connected to the holder body by means of flat protrusions 10, is made with T-shaped longitudinal section, and the other part 15 of the stand is made with H-shaped longitudinal section. The vertical portion 16 of the T-shaped part of the stand is configured to be arranged into the upper groove 17 of the H-shaped part of the stand 9. The dimensions of the vertical portion 16 of the T-shaped part of the stand correspond to the dimensions of the upper groove 17 of the H-shaped part of the stand to allow unrestricted rotation of the vertical portion of the T-shaped part of the stand inside the groove of the H-shaped part of the stand, simultaneously providing for a contact between the upper end face surface of the H-shaped part of stand and the horizontal surface of the T-shaped part of the stand arranged around its vertical portion. In the vertical portion 16 of the T-shaped part of the stand is provided a central longitudinal threaded hole 18, and in the horizontal portion of the H-shaped part of the stand is provided a central through the hole 19, the diameter of which corresponds to the diameter of the longitudinal threaded hole 18. Both parts 14 and 15 of the stand 9 are interconnected by means of a screw 20 to be mounted at the side of the lower groove of the H-shaped part 15 of the stand. The screw 20 passing freely the central hole 19 is screwed into the central longitudinal threaded hole 18. The length of the screw leg 20 is larger than the combined height of both holes 18 and 19 so that the free part 21 of the screw leg 20, the length of which is measured from its head to the horizontal portion of the H-shaped part of the stand, can be arranged in the lower groove of the H-shaped part of the stand. The contacting with each other surfaces of the H-shaped and T-shaped parts of the stand are provided in a zigzag shape with the possibility of arranging a zigzag protrusion of one contacting surface in the zigzag groove of the other contacting surface. On the free part 21 of the screw leg 20 is arranged the first spring 22 in a normally compressed state. In the lower groove of the H-shaped part of the stand are arranged two T-shaped elements 23 and 24, the vertical portions of which are connected with each other by means of the axis 25 with the possibility of rotation of the T-shaped elements around it. The horizontal portions of both T-shaped elements 23 and 24 are oriented in opposite directions. The horizontal portion of the first T-shaped element 23 is facing the horizontal portion of the H-shaped part 15 of the stand. In the horizontal portion of the first T-shaped element 23 a cavity 26 is provided, in which is arranged a normally released second spring 27 with its longitudinal axis directed along the horizontal portion of the first T-shaped element 23. On the lateral surface of the horizontal portion of the first T-shaped element 23 is provided a hole 28 for communicating with the first hole 29 made in the lower vertical portion of the H-shaped part 15 of the stand. Holes 28 and 29 are intended for accommodating an outwardly extending button 30, which has an elongated shape and acting as stopper for the upper T-shaped element 23 when it engages with the said holes 28 and 29. Button 30 is mounted with the possibility of impacting on the second spring 27, whereby the longitudinal movement of the button 30 causes a corresponding compression of the second spring 27 with a subsequent movement of the button 30 into the cavity 26 with the release of the button 30 from engagement with the hole 29. In the lower groove of the H-shaped part 15 of the stand between the horizontal portion of the H-shaped part 15 of the stand and the horizontal portion of the first T-shaped element 23 coaxially with the stand 9 is arranged a normally compressed third spring 31 to ensure pushing out of the first T-shaped element 23 outward when the button 30 is released from engagement with the hole 29. When the first T-shaped element 23 is in its fully extended position, the axis 25 connecting both T-shaped elements is located outside. Fixation of the extended position of the first T-shaped element 23 is provided for by engaging the button 30 with a second hole 32, made in the lower vertical portion of the H-shaped part 15 of the stand and arranged below the second hole 29. Engagement of the button 30 with the second hole 32 occurs when the horizontal portion of the first T-shaped element 23 reaches the level of the hole 32 and when the axes of the button 30 and the hole 32 coincide, wherein, under the action of the compressed second spring 27 the button 30 is extended into the hole 32 for engagement with it. The outer surface of the horizontal portion of the second T-shaped element 24 is provided with a central threaded hole 33 for connection with the means for fastening the stand to support surfaces. In order to secure the stand to a flat horizontal surface, the stand 9 is connected to a vacuum cup 34 provided with a threaded support pin configured to be screwed into the central threaded hole 33. In order to connect the stand to the tubular, ribbed surfaces, the second T-shaped element 24 is connected to a claw clamp 35 provided with a threaded support pin 36 configured to be screwed into the hole 33. The claw clamp is known and presented, for example, in sources: https://batareika36.ru/derzhatel-telefona/derzhatel-telefona-s022-ph03-kleshnya-udlin.html, https://dm-opt.ru/accessories/derzhateli-krepleniia/avtomobilnye-derzhateli-1/3804--2200000077356/. The fastening of the stand 9 to a vertical surface is provided by two vacuum cups 37 provided with support pins 38 intended for screwing into the threaded holes 39 and 40, made one above the other in the vertical portion of the H-shaped part 15 of the stand. The horizontal portion of the second T-shaped element 24 in the initial position is located outside the lower groove of the H-shaped part 15 of the stand.

The operation of the claimed holder for hairdryer is implemented as follows.

The stand is fastened to a surface that is accessible to the user in a specific environment. The handle of the hairdryer is located in the opening 8. The body 1 is tilted as desired by rotating it around the axis 4 and the required position of the body 1 in relation to the stand 9 is fixed by the screw 5. In order to rotate the body 1 in the desired direction, the T-shaped part 14 of the stand rotates around its axis, when the T-shaped part 14 of the stand is lowered, it is lowered on the H-shaped part 15 of the stand, being fixed by placing of mutual protrusions and grooves of the contacting with each other zigzag surfaces of both parts 14 and 15 of the stand. The height of the holder is adjusted by pressing the button 30 until it sinks beyond the hole 29, wherein the T-shaped part 14 of the stand under the action of the spring 31 is pushed outward to a distance corresponding to the distance between the holes 29 and 32. When button 30 reaches the hole 32 then it under the action of the spring 27 is pushed out of the cavity 26 into the interior of the hole 32, engaging with it. In this arrangement, the button 30 will prevent further longitudinal movement of the T-shaped elements 23 and 24. At the fully extended position of the T-shaped elements 23 and 24, the axle 25 connecting them is located outside, so that the T-shaped elements can rotate relative to each other to reach the desired position. After use, the hair dryer holder is removed from the surface on which it was mounted, and the fastening elements are unscrewed from the stand 9, which is rotated around the axis 4 and placed inside the body 1. The holder for hairdryer is stored in the folded state, in which it takes up minimal space. Thus, in the claimed holder for hairdryer the maximum possible variants for adjusting of a position of the holder are provided, allowing it to be adapted to any surfaces available to the user, dimensional conditions. The claimed holder is easy to use and ergonomic.

The invention claimed is:

1. A holder for a hairdryer, comprising an elongated body having a U-shaped cross-section and being made of an elastic material, flat lateral sides of a fastening end of the holder body are provided with opposite holes for accommodating an axis of the holder body, detachably fastened from the outside of both sides of the holder body, wherein one end of the holder body axis is provided with a thread for connection with a fixing screw configured to press or release the lateral sides of the holder body in relation to each other, the holder body is arranged on the axis of the holder body with the possibility of rotation around it, on lateral sides of the opposite end of the holder body are provided opposite holes for accommodating therein ends of an elastic belt with forming an opening between the inner surface of the holder body and the belt to accommodate a handle of a hairdryer, wherein between the sides of the holder body on its axis is fastened a stand, made rotatable around the axis of the holder body, for this purpose one end of the stand is provided with not less than two parallel flat protrusions with holes, by means of which the stand is arranged on the holder body axis, wherein the transverse dimension of the stand being less than the distance between the sides of the holder body, inside the holder body on its fastening end between the sides, an insert made of an elastic material is tightly mounted and fastened, wherein the insert is provided either as a separate element or integral with the holder body, the insert is provided with a longitudinal section of a W-shaped form having vertical sides, wherein the flat protrusions of the stand are arranged in grooves formed between the adjacent vertical sides of the W-shaped insert, the stand is made cylindrical, comprising a T-shaped part and a H-shaped part, wherein the T-shaped part of the stand is connected to the holder body by means of the flat protrusions and is made with a T-shaped longitudinal section, and the H-shaped part of the stand is made with an H-shaped longitudinal section having an upper groove at an upper side of the H-shaped longitudinal section and a lower groove at a lower side of the H-shaped longitudinal section, a vertical portion of the T-shaped part of the stand is configured to be arranged in the upper groove of the H-shaped part of the stand, the dimensions of the vertical portion of the T-shaped part of the stand correspond to the dimensions of the upper groove of the H-shaped part of the stand to allow unrestricted rotation of the vertical portion of the T-shaped part of the stand inside the upper groove of the H-shaped part of the stand, simultaneously providing for a contact between an upper end face surface of the H-shaped part and a horizontal surface of the T-shaped part of the stand arranged around its vertical portion, in the vertical portion of the T-shaped part of the stand is provided a central longitudinal threaded hole, in the horizontal portion of the H-shaped part of the stand is provided a central through hole the diameter of which corresponds to the diameter of the longitudinal threaded hole provided in the T-shaped part of the stand, the T-shaped part and the H-shaped part of the stand are interconnected by means of a screw to be installed at the side of the lower groove of the H-shaped part of the stand, the screw passing freely the central through hole in the horizontal portion of the H-shaped part of the stand is screwed into the central longitudinal threaded hole in the vertical portion of the T-shaped part of the stand, the length of the screw leg is larger than the combined height of the longitudinal threaded hole and the central through hole so that a free part of the screw leg, the length of which is measured from the screw head to the horizontal portion of the H-shaped part of the stand, can be arranged in the lower groove of the H-shaped part of the stand, the contacting with each other surfaces of the H-shaped and T-shaped parts of the stand are provided in a zigzag shape with the possibility of arranging a zigzag protrusion of one contacting surface in a zigzag groove of the other contacting surface, on the free part of the screw leg between the screw head and the horizontal portion of the H-shaped part of the stand is arranged a first spring in a normally compressed state, in the lower groove of the H-shaped part of the stand are arranged a first and a second T-shaped elements, the vertical portions of which are connected with each other by means of an axis with the possibility of rotation of the T-shaped elements around it, wherein the horizontal portions of the first and second T-shaped elements are oriented in opposite directions to each other, the horizontal portion of the first T-shaped element is facing the horizontal portion of the H-shaped part of the stand, wherein in the horizontal portion of the first T-shaped element a cavity is provided, in which is arranged a second spring in a normally released state with its longitudinal axis directed along the horizontal portion of the first T-shaped element, on the lateral surface of the horizontal portion of the first T-shaped element is provided a hole communicating with a first hole provided in the lower vertical portion of the H-shaped part of the stand, the hole of the T-shaped element and the first hole of the H-shaped part are intended for accommodating an outwardly extending button having an elongated shape and acting as a stopper for the upper T-shaped element when the button engages with the hole of the T-shaped element and the first hole of the H-shaped part, the button is mounted with the possibility of impacting the second spring, whereby the longitudinal movement of the button causes a corresponding compression of the second spring with subsequent movement of the button inside the cavity, wherein the second spring is arranged with the button disengaged from the first hole provided in the lower vertical portion of the H-shaped part of the stand, in the lower groove of the H-shaped part of the stand between the horizontal portion of the H-shaped part of the stand and the horizontal portion of the first T-shaped element coaxially with the stand is arranged a normally compressed third spring to ensure pushing out of the first T-shaped element outwardly when the button is released from engagement with the first hole provided in the lower vertical portion of the H-shaped part of the stand, wherein at the fully extended position of the first T-shaped element the location of the axis connecting the first and second T-shaped elements are provided on the outside, fixation of the extended position of the first T-shaped element is provided for by engaging the button with a second hole provided in the lower vertical portion of the H-shaped part of the stand and arranged below the first hole provided in the lower vertical portion of the H-shaped part of the stand, engagement of the button with the second hole is provided for when the horizontal portion of the first T-shaped element reaches the level of the second hole and when the axes of the button and the second hole coincide, under the action of the compressed second spring outward movement of the button is provided into the second hole for engagement.

2. The holder according to claim 1, wherein the outer surface of the horizontal portion of the second T-shaped element is provided with a central threaded hole for connection with means for fastening the stand to support surfaces.

3. The holder according to claim 2, wherein in order to provide for fastening the stand to a flat horizontal surf ace, the stand is connected to a vacuum cup provided with a threaded support pin configured to be screwed into the central threaded hole, provided on the outer surface of the horizontal portion of the second T-shaped element.

4. The holder according to claim 2, wherein the second T-shaped element is connected to a claw clamp provided with a threaded support pin configured to be screwed into the central threaded hole, provided on the outer surface of the horizontal portion of the second T-shaped element.

5. The holder according to claim 1, wherein the fastening of the stand to a vertical flat surface is provided for by two vacuum cups provided with support pins configured to be screwed into the threaded holes, provided one above the other in the vertical portion of the H-shaped part of the stand.

6. The holder according to claim 1, wherein the horizontal portion of the second T-shaped element in the initial position is arranged outside the lower groove of the H-shaped part of the stand.

7. The holder according to claim 1, wherein the body of the holder is made of an elastic plastic.

8. The holder according to claim 1, wherein the body of the holder is made of aluminum.

9. The holder according to claim 1, wherein the insert is made of an elastic plastic.

10. The holder according to claim 1, wherein the insert is made of aluminum.

* * * * *